US010072832B2

(12) United States Patent
Goldman et al.

(10) Patent No.: US 10,072,832 B2
(45) Date of Patent: Sep. 11, 2018

(54) LIGHTING ASSEMBLIES

(71) Applicant: ZODIAC POOL SYSTEMS, INC., Vista, CA (US)

(72) Inventors: David Goldman, Carlsbad, CA (US); Hwa Leung Heng, Vista, CA (US)

(73) Assignee: ZODIAC POOL SYSTEMS LLC, Vista, CA (US)

( * ) Notice: Subject to any disclaimer, the term of this patent is extended or adjusted under 35 U.S.C. 154(b) by 87 days.

(21) Appl. No.: 15/044,640

(22) Filed: Feb. 16, 2016

(65) Prior Publication Data

US 2016/0238223 A1 Aug. 18, 2016

Related U.S. Application Data

(60) Provisional application No. 62/117,795, filed on Feb. 18, 2015.

(51) Int. Cl.

| | |
|---|---|
| ***F21V 33/00*** | (2006.01) |
| ***F21V 23/04*** | (2006.01) |
| ***F21V 31/00*** | (2006.01) |
| *F21Y 101/02* | (2006.01) |
| *F21W 131/401* | (2006.01) |

(52) U.S. Cl.

CPC ..... *F21V 23/04* (2013.01); *F21V 23/0442* (2013.01); *F21V 23/0485* (2013.01); *F21V 31/00* (2013.01); *F21W 2131/401* (2013.01); *F21Y 2101/02* (2013.01)

(58) Field of Classification Search

CPC .. F21V 23/04; F21V 23/0442; F21V 23/0485; F21V 23/0492; F21V 31/00; F21W 2131/401

USPC ..... 362/101, 249.05, 276, 295, 802

See application file for complete search history.

(56) References Cited

U.S. PATENT DOCUMENTS

| | | | | |
|---|---|---|---|---|
| 7,023,004 | B2 * | 4/2006 | Ford | F21L 4/02 250/493.1 |
| 2005/0265031 | A1 * | 12/2005 | Mosholder, Jr. | F21S 8/00 362/368 |
| 2006/0092630 | A1 | 5/2006 | Kennedy et al. | |

FOREIGN PATENT DOCUMENTS

| | | |
|---|---|---|
| CA | 2486927 | 5/2006 |
| EP | 0468291 | 1/1992 |
| EP | 2469163 | 6/2012 |
| EP | 3268666 | 1/2018 |
| GB | 2224343 | 5/1990 |
| WO | 8503682 | 8/1985 |
| WO | 2016133892 | 8/2016 |

OTHER PUBLICATIONS

International Patent Application No. PCT/US2016/018049 , International Search Report and Written Opinion, dated Apr. 14, 2016, 12 pages.

(Continued)

*Primary Examiner* — Jason Moon Han

(74) *Attorney, Agent, or Firm* — Kilpatrick Townsend & Stockton LLP; Dean W. Russell

(57) ABSTRACT

Aspects of lighting assemblies principally for pools and spas are addressed. The assemblies may be configured to operate without penetrating housings thereof, thus not adversely impacting waterproof characteristics of the housings. This result is especially beneficial when the housings are installed underwater within pools or spas.

7 Claims, 1 Drawing Sheet

(56) References Cited

OTHER PUBLICATIONS

International Patent Application No. PCT/US2016/018049, "International Preliminary Report on Patentability", dated Aug. 31, 2017, 8 pages.

* cited by examiner

LIGHTING ASSEMBLIES

CROSS-REFERENCE TO RELATED APPLICATION

This application claims the benefit of and priority to U.S. Provisional Patent Application Ser. No. 62/117,795, filed Feb. 18, 2015, and having the same title as appears above, the entire contents of which application are hereby incorporated by this reference.

FIELD OF THE INVENTION

This invention relates to lighting and more particularly, but not necessarily exclusively, to lighting assemblies for pools and spas (collectively referred to herein as "pools").

BACKGROUND OF THE INVENTION

Pool owners frequently enjoy illuminating water within their pools, water in associated features (such as fountains), and areas surrounding their pools and features. Underwater lighting assemblies, typically utilizing light-emitting diodes (LEDs), are especially popular among owners of pools. Many such lighting assemblies may communicate with electronic controllers so as to change colors over time, allowing pool owners to create custom pool-centric "light shows" merely by appropriately programming color-sequence schemes of one or more lighting assemblies.

Because of their popularity, underwater lighting assemblies are marketed by multiple manufacturers. Generally, though, the assemblies are paired with control or automation equipment of the manufacturer, so that a lighting assembly of one manufacturer will not necessarily function when electronically coupled to a controller of another manufacturer. Consequently, distributors of lighting assemblies for pools often carry excess inventory to ensure compatibility with all control equipment of the various manufacturers. Because of space restrictions in service vehicles, moreover, some lighting installers are required to make two trips to a pool location—a first trip to identify the pool owner's control equipment and, after identifying a compatible lighting assembly from its stored inventory, a second trip to install the assembly.

At least one manufacturer has attempted to develop a lighting assembly compatible with multiple generations of its own controllers. The lighting assembly is capable of providing color-related feedback to an installer which may be correlated with other information to determine which control scheme it is emulating. (For example, the installer may perform a test series of on-off cycles with specific timing sequences in an effort to produce a particular result—e.g. solid red illumination, with that result signifying that the lighting assembly is operating in a particular mode.) In practice, however, the test series seem both complex and difficult to perform reliably.

Need thus clearly exists for a more reliable method of determining compatibility of a lighting assembly with particular control equipment already installed (or to-be-installed) for a particular pool. Need also exists for lighting assemblies that are compatible with different lighting programs and automation equipment of different manufacturers. Indeed, one possible solution to these needs is to create a lighting assembly with a mode-selection dial or other switch (e.g. a slide, rotary, or similar type switch) in which an installer, pool owner, or other person can simply change the position of the switch to cause the assembly to operate in a particular mode. However, adding such a switch to a lighting assembly is not necessarily easy to do satisfactorily, as the switch could adversely impact the water resistance of the assembly. This adverse impact could be especially acute for lighting assemblies to be installed within the pool (i.e. underwater).

DETAILED DESCRIPTION

Figure 1:
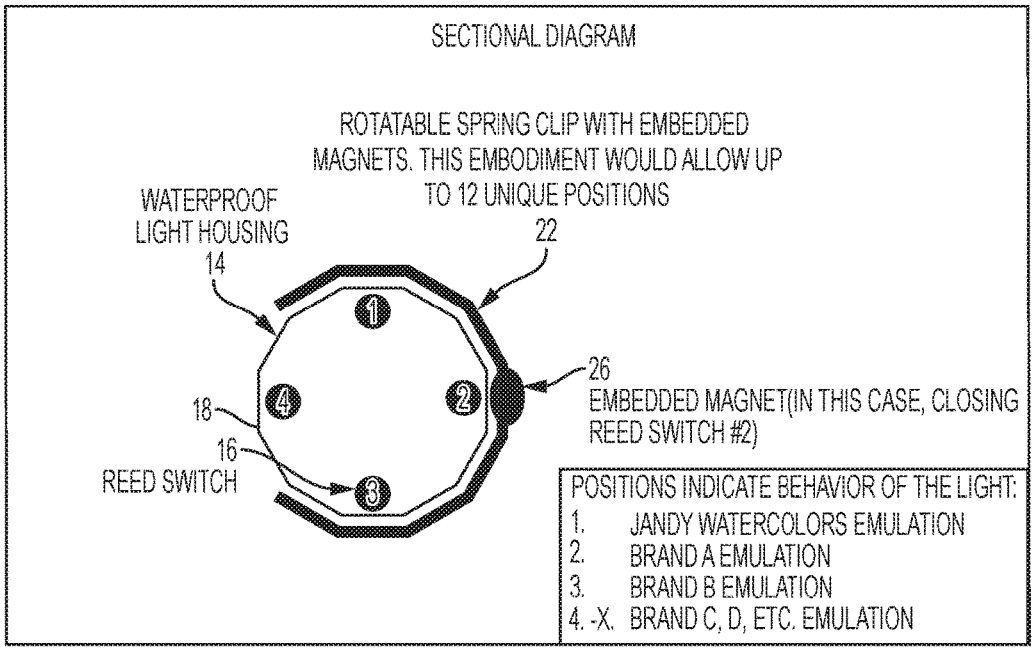
FIG. 1 illustrates portions of a first exemplary lighting assembly consistent with the present invention.

The present invention seeks to solve these needs without disrupting integrity of the waterproof housings of underwater lighting assemblies. As illustrated in FIG. 1, one or more magnetic-closure (reed) switches 10 may be incorporated into housing 14 of a lighting assembly. Because switches 10 are contained within housing 14 and do not penetrate its outer surface 18, their presence does not adversely affect the waterproof characteristics of the housing 14. Although four such switches 10 are depicted in FIG. 1, more or fewer switches may be included within housing 14. Advantageously, though, housing 14 will contain more than one switch 10. Alternatively, Hall Effect or other sensors may be employed instead of switches 10.

Also shown in FIG. 1 is clip 22. Clear from the drawing is that clip 22 is positioned to the exterior of housing 14 and does not penetrate it. Hence, neither switches 10 nor clip 22 prevents housing 14 from being waterproof.

At least one version of clip 22 is a rotatable spring biased into frictional contact with outer surface 18. The bias advantageously may be sufficient to prevent clip 22 from sliding along the length of housing 14 yet able to be overcome easily by manual force. Accordingly, clip 22 may rotate about a periphery of housing 14 under manual force. Alternatively, clip 22 may rotate under influence of a tool. Although FIG. 1 depicts outer surface 18 as twelve-sided and clip 22 as having nine connected segments, either or both of outer surface 18 and clip 22 may be shaped differently if desired.

FIG. 1 additionally illustrates magnet 26 embedded within clip 22. As clip 22 rotates, so too does magnet 26. If switches 10 are spaced within housing 14 near the periphery, rotation of clip 22 may cause magnet 26 to become adjacent to a particular switch 10, thereby closing it. Closure of the particular switch 10 allows electricity to flow through a specific circuit, thereby causing the lighting assembly to operate in a particular mode or otherwise behave in a particular manner.

For example, the four switches 10 of FIG. 1 are denominated "1," "2," "3," and "4." Closure of "1" results in the lighting assembly emulating a Jandy Watercolors light, closure of "2" causes the lighting assembly to emulate a light of "Brand A," closure of "3" produces emulation of a "Brand B" light, and closure of "4" results in emulation of a "Brand C" light. In this example clip 22 is positioned so that magnet 26 is adjacent the switch 10 denominated "2," causing the lighting assembly to emulate a "Brand A" light. Alternatively or additionally, closure of different switches could produce displays of different colors or ranges of colors of light or any other desired lighting display.

Figure 2:
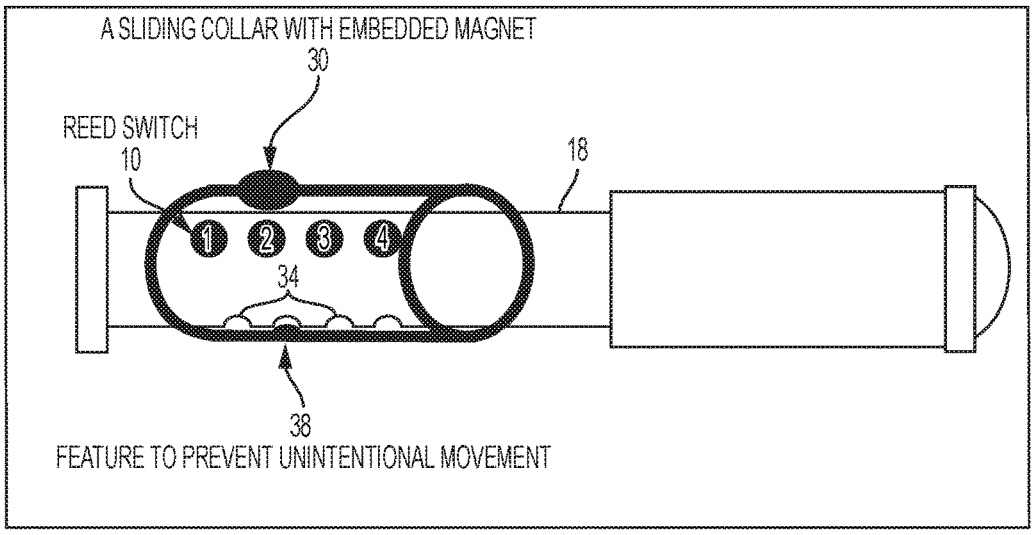
FIG. 2 illustrates portions of a second exemplary lighting assembly consistent with the present invention.

Shown in FIG. 2 is collar 30, which may serve as an alternative to clip 22. Rather than rotating like clip 22, collar 30 may slide (generally linearly) along outer surface 18 so that its embedded magnet 26 is adjacent a switch 10. FIG. 2 further illustrates a series or notches or recesses 34 into which a protrusion 38 of collar 30 may fit so as to effect appropriate positioning of magnet 26 adjacent a particular switch 10 and protect the positioning against at least some undesired movements.

Persons skilled in the relevant art will understand that FIGS. 1 and 2 merely depict examples of the present invention and thus that other implementations also are possible. Indeed, any method of reliably rendering a lighting assembly compatible with various controls using a simple switching mechanism conceivably could be within the scope of the current invention. This is true especially (although not necessarily) if the switching mechanism avoids adversely impacting the waterproof nature of the lighting assembly. Consequently, the foregoing is provided for purposes of illustrating, explaining, and describing embodiments of the present invention, and modifications and adaptations to these embodiments will be apparent to those skilled in the art and may be made without departing from the scope or spirit of the invention.

What is claimed is:

1. A method of causing an underwater swimming pool or spa lighting assembly to emulate lighting of at least first, second, and third lighting types, comprising:

a. providing (i) a lighting housing (A) having an outer surface and (B) containing at least first, second, and third switches or sensors therein, the number of switches or sensors within the lighting housing having a 1:1 correspondence with the number of lighting types to be emulated and (ii) moveable means, external to the lighting housing and configured to slide generally linearly along the outer surface, for changing conductive states of each of the at least first, second, and third switches or sensors; and b. sliding the moveable means generally linearly along the outer surface so as to cause the first switch or sensor to change its conductive state, thereby causing the assembly to emulate lighting of the first lighting type and display it within the swimming pool or spa.

2. A method according to claim 1 in which the moveable means comprises a magnet and the at least first, second, and third switches or sensors are reed switches.

3. A method according to claim 1 in which the first lighting type is lighting of a first manufacturer and the second lighting type is lighting of a second manufacturer.

4. A method according to claim 1 in which the moveable means comprises a collar having a magnet embedded therein.

5. A method according to claim 1 further comprising moving the moveable means so as to cause the second switch or sensor to change its conductive state, thereby causing the assembly to emulate lighting of the second lighting type and display it within the swimming pool or spa.

6. A method of causing an underwater swimming pool or spa lighting assembly to emulate lighting of at least first, second, and third lighting types, comprising:

a. providing (i) a lighting housing (A) having an outer surface and (B) containing at least first, second, and third switches or sensors therein and (ii) moveable means, external to the lighting housing and configured to slide generally linearly along the outer surface, for changing conductive states of each of the at least first, second, and third switches or sensors; and b. sliding the moveable means generally linearly along the outer surface so as to cause the first switch or sensor to change its conductive state, thereby causing the assembly to emulate lighting of the first lighting type and display it within the swimming pool or spa.

7. A method of causing an underwater swimming pool or spa lighting assembly to emulate lighting of at least first, second, and third lighting types, comprising:

a. providing (i) a lighting housing (A) having an outer surface and (B) containing at least first, second, and third switches or sensors therein and (ii) a collar, external to the lighting housing and configured to slide generally linearly along the outer surface, for changing conductive states of each of the at least first, second, and third switches or sensors; and b. sliding the collar generally linearly along the outer surface so as to cause the first switch or sensor to change its conductive state, thereby causing the assembly to emulate lighting of the first lighting type and display it within the swimming pool or spa.

* * * * *